United States Patent [19]

Rickey

[11] 4,324,399

[45] Apr. 13, 1982

[54] EXERCISING DEVICE

[76] Inventor: Robert B. Rickey, 2871 Bannockburn, Memphis, Tenn. 38128

[21] Appl. No.: 153,752

[22] Filed: May 27, 1980

[51] Int. Cl.[3] ..... A63B 23/00

[52] U.S. Cl. ..... 272/144; 272/120; 272/122; 272/127; 272/131

[58] Field of Search ..... 272/122, 123, 127, 128, 272/134, 144–146, 93, 120, 131, DIG. 3, DIG. 4, 72

[56] References Cited

U.S. PATENT DOCUMENTS

| | | | |
|---|---|---|---|
| 1,982,843 | 12/1934 | Traver | 272/72 X |
| 2,129,262 | 9/1938 | Cole | 272/144 |
| 2,676,015 | 4/1954 | Courtney | 272/144 |
| 2,733,922 | 2/1956 | Diego | 272/120 |
| 3,101,944 | 8/1963 | Cencig | 272/131 |
| 3,130,968 | 4/1964 | De Feen | 272/127 |
| 3,173,415 | 3/1965 | Rubin | 272/145 X |
| 3,226,115 | 12/1965 | Underhill | 272/145 X |
| 3,589,720 | 6/1971 | Agamian | 272/131 |
| 3,809,393 | 5/1974 | Jones | 272/127 |
| 3,817,243 | 6/1974 | Perrine | 272/145 X |
| 3,892,404 | 7/1975 | Martucci | 272/120 X |
| 3,971,556 | 7/1976 | Petrie et al. | 272/122 |
| 4,089,528 | 5/1978 | Green | 272/122 |
| 4,221,915 | 12/1980 | Noble et al. | 272/145 |
| 4,229,001 | 10/1980 | Roman | 272/131 X |

FOREIGN PATENT DOCUMENTS

| | | | |
|---|---|---|---|
| 2261319 | 6/1974 | Fed. Rep. of Germany | 272/126 |
| 607460 | 8/1948 | United Kingdom | 272/144 |

*Primary Examiner*—Richard J. Apley
*Attorney, Agent, or Firm*—Walker & McKenzie

[57] ABSTRACT

A device for exercising particular muscles of a user as he selectively accomplishes various exercises in conjunction therewith. The device is characterized by an oblong board member having a size to comfortably support the user's torso and head. The board may be used in several different modes or manners, one of which involves roller apparatus which facilitates traveling the board to-and-fro while in a horizontal disposition. In this mode, track structure is utilized in conjunction with the roller apparatus. In another mode, the board is supported in an inclined stationary fashion to provide, in one instance, an "abdominal board" and in another instance a "slant board". The roller apparatus is made use of in this latter mode to constitute a pair of legs for supporting the elevated end of the board. Other structure which serves a dual function is utilized in reconfiguring the device for compatibility with the performance of many different exercises.

1 Claim, 24 Drawing Figures

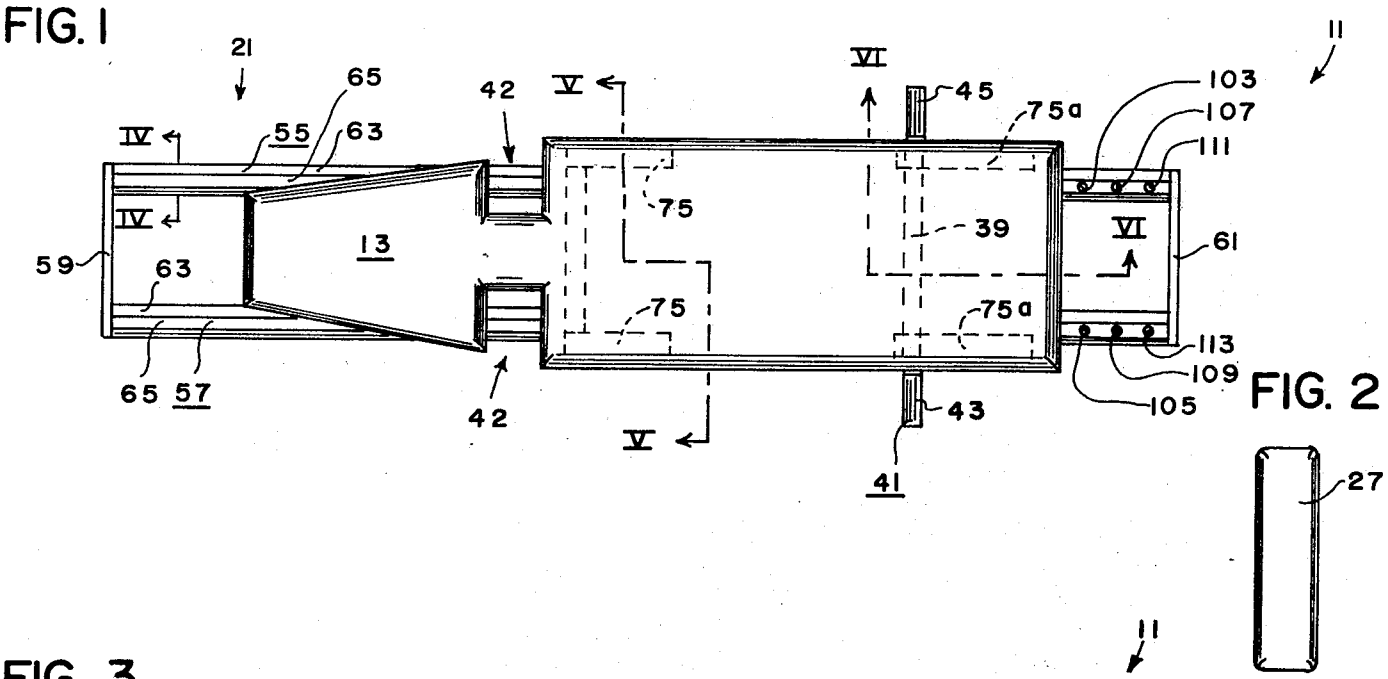
FIG. 1
FIG. 2
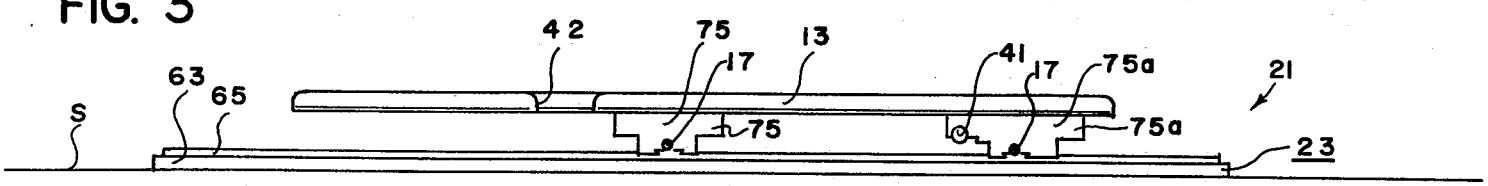
FIG. 3

21
23
53
55
57
59
61
63
65
67
69
71
73
75
79
81
83
85
87
89
103
105
107
109
111
113
13
17
XIV

EXERCISING DEVICE

CROSS-REFERENCE TO RELATED APPLICATION

The present application is an improvement over my previously filed application for "Exercising Device" filed Jan. 20, 1976 having a Ser. No. 653,656 and which is now abandoned.

BACKGROUND OF THE INVENTION

1. Field of the Invention

This invention relates to the field of body exercising devices and is particularly directed toward devices used in developing the abdominal muscles.

2. Description of the Prior Art

According to certain articles read by applicant, there are as many as 7,000,000 back aches a year, in this country alone, severe enough to require medical attention.

The adage "necessity is the mother of invention" certainly holds true for the instant invention. In other words, applicant developed this device because he was suffering from a severe back problem, specifically a ruptured disc, which is earlier years caused him untold misery. In fact, he is absolutely convinced that were it not for this exercise program, and particularly the type exercises he performs with this device, he would now be a near invalid. Moreover, recent x-rays taken of the applicant show that he still has the problem. However, the difference now is that he has strengthened his stomach and abdominal muscles to such an extent that he can now lead a somewhat normal existence, even to the extent of including three hours of playing tennis at a time, i.e., the stomach and abdominal muscles are believed to be the most important muscles to strengthen when experiencing this malady, perhaps surprisingly, even more so than the back muscles.

According to other certain articles read by applicant, the medical authorities specializing in this field go along with this theory but they apparently don't know about this therapy—YET! Applicant maintains that this principle is the motivating factor in his filing of this application, i.e., he whole heartedly believes that most of the people suffering from back problems can benefit immeasurably through adopting a proper exercise program in conjunction with the device to be disclosed herein.

It is widely accepted that a protruding abdomen is not necessarily attributable to fat but often is a result of prolapse or a collapse of the muscular sheath reaching from the rib cage to the groin. General inactivity of modern man is probably the chief factor in bringing about this prolapse. For example, even an inactive businessman who spends his entire day at a desk does, in fact, exercise his legs when walking to and from his car, etc., and exercises his arms by accomplishing such simple task as opening and closing doors and the like. However, the abdominal muscles of an inactive individual are exercised very little, if at all. Accordingly, they become weaker and weaker as his activity diminishes, i.e., it is a natural tendency for an individual to become less active as he ages.

Many aging individuals recognize this fact and adopt a standard exercise program hoping to overcome this malady. Unfortunately, standard exercises don't necessarily accomplish the desired end results. Two exercises which are widely accepted as being the most effective abdominal muscle exercises are the well known sit ups and leg lifts. However, the high number of repetitions and the speed of preformance required to obtain significant benefits render these exercises to be unrealistic when used exclusively as an exercise program for the abdominal muscles.

Applicant is aware of two exercise devices which are directed towards exercising the abdominal muscles. The first of these devices is simply a single, or dual, wheel rotatably supported at the intermediate portion of an elongated rod having hand grip portions on the remote ends thereof. This device is normally used by assuming a kneeling position with the hands grasping either end of the rods and working the arms allowing the wheel to roll forward and aft. This motion is effective in enabling the user to carry his weight as he reaches forward thus assuming a prone position and as he completes the exercise cycle by raising himself again to the kneeling position. It should be mentioned that neither the manufacturer nor the inventor of the above mentioned device is known to the applicant.

The other of the above mentioned devices is offered by Meehan Associates, 380 Madison Avenue, New York, N.Y 10017 and is identified by Meehan Associates as a TRIM-TRAIN. This latter device consists of a four-wheeled cushion or vehicle that runs on a five-foot track. A pair of immovable hand holds are attached to the base structure which supports the track. This device is used by assuming a kneeling position with the knees comfortably resting on the padded vehicle and while grasping the fixed hand holds, the user simply cyclically straightens and bends his legs. Thus, the vehicle runningly rides the track structure in rearward and forward directions respectively. It should be mentioned that neither of the above described devices suggest or disclose applicant's exercising device.

The above described exercise used in conjunction with the former device may hereinafter be referred to as "roll-outs" while the exercise described in conjunction with the latter of the above described devices may hereinafter be referred to as "reverse roll-outs". Sit ups and leg lifts are normally accomplished without the aid of any device other than perhaps slipping the feet under a heavy object such as a dresser or bed to assist in the accomplishment of sit ups. Applicant believes that more effective abdominal muscle exercising can be achieved by adopting an exercise program which includes all four of the above exercises, i.e., sit ups, leg lifts, roll-outs, and reverse roll-outs. Unfortunately, many individuals allow themselves to get in such poor physical shape that they are not able to accomplish the sit ups and leg lifts without some form of assistance. Neither of the above described devices nor, for that matter, any other device known by the applicant provides structure for assisting in or facilitating the accomplishment of sit ups or leg lifts.

SUMMARY OF THE INVENTION

The present invention is directed towards overcoming the problems and disadvantages of prior devices. The concept of the present invention is to provide an exercising device that will offer assistance in, or facilitate the accomplishment of, sit ups and leg lifts and additionally provide a device for accomplishing roll-outs and reverse roll-outs among other exercises. The exercising device of the present invention includes an oblong board member having a size to normally comfortably support the user's torso and head. However, the device lends itself towards being reconfigured into various different arrangements one of which extends the effective length of the board so as to accommodate the user's feet for accomplishing certain type exercises.

The board may be used in several different modes or manners, one of which involves roller apparatus which facilitates traveling the board to-and-fro while in a horizontal disposition. In this mode, track structure is utilized in conjunction with the roller apparatus.

In another mode, the board is supported in an inclined stationary fashion to provide, in one instance, an "abdominal board" and in another instance, a "slant board". The roller apparatus is made use of in this latter mode to constitute a pair of legs which slip-fit into a pair of sockets for supporting the elevated end of the board. Other structure which serves a dual function is utilized in reconfiguring the device for compatibility with the performance of many different exercises.

An important feature of the present invention is the fact that it includes means for promoting resistance against enabling the planar board member to merely be free to travel to-and-fro as it is being runningly ridably supported by the roller structure. In this manner, the user is required to exert more effort in the performance of certain exercises than would normally be expected, i.e., than if the to-and-fro travel of the board member were to be conventionally unconstrained.

This means for promoting resistance is disclosed herein in at least two forms, one of which includes means for abnormally developing friction between the roller structure and the planar board member. Another manner of promoting this resistance includes inertia means for providing a degree of constraint to the to-and-fro travel of the planar board member. In this latter instance, the inherent massiveness of the roller structure contributes to the means for promoting resistance.

The roller structure is particularly configured for being guidingly constrained to the track structure so as to be maintained in an optimum relationship with the track structure as the board is urged to travel to-and-fro there along.

Another important feature of the present invention is the fact that the roller structure may alternately be used as a leg structure for elevating one end of the board or, due to the massiveness thereof they may be used as "dumb bells" for use in exercising certain muscles.

DESCRIPTION OF THE DRAWINGS

FIG. 1 is a top plan view depicting one configuration of the exercising device of the present invention.

FIG. 2 is a top plan view of an auxiliary member of the exercising device.

FIG. 3 is a side elevational view of the structure depicted in FIG. 1.

FIG. 24 is a plan view of the framelike means.

DESCRIPTION OF THE PREFERRED EMBODIMENT

The exercising device 11 of the present invention is intended for exercising certain muscles of the user, characterized herein by the letter U, as he selectively accomplishes various exercises in conjunction with the device 11. It should be understood that while the device 11 will be disclosed in a preferred embodiment, an important feature thereof is the fact that it may be arranged in several different configurations. Indeed, certain structure which may be depended upon for accomplishing the different configurations strongly supports the inventive concepts of the device 11.

Figure 7:
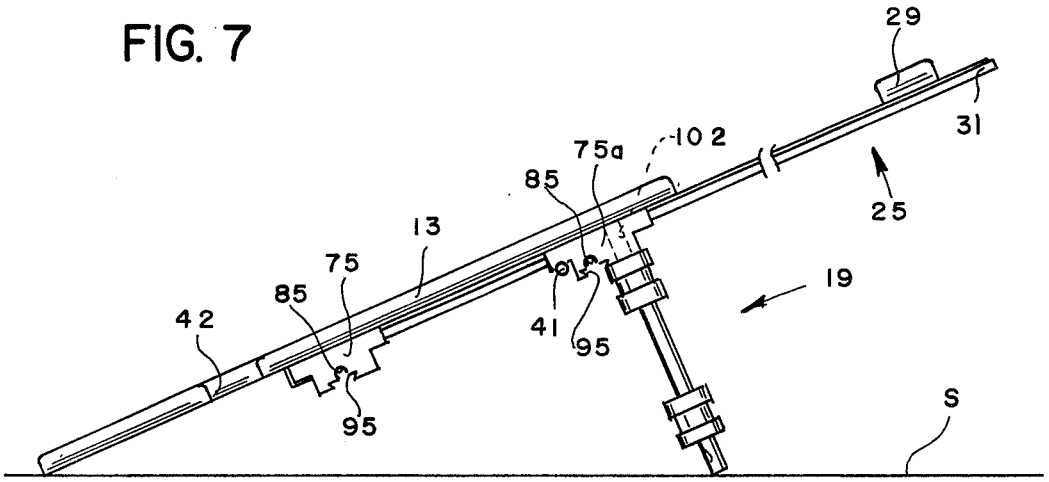
FIG. 7 depicts the exercising device of the present invention arranged in a particular configuration so as to constitute what is commonly known as a slant board.
Figure 8:
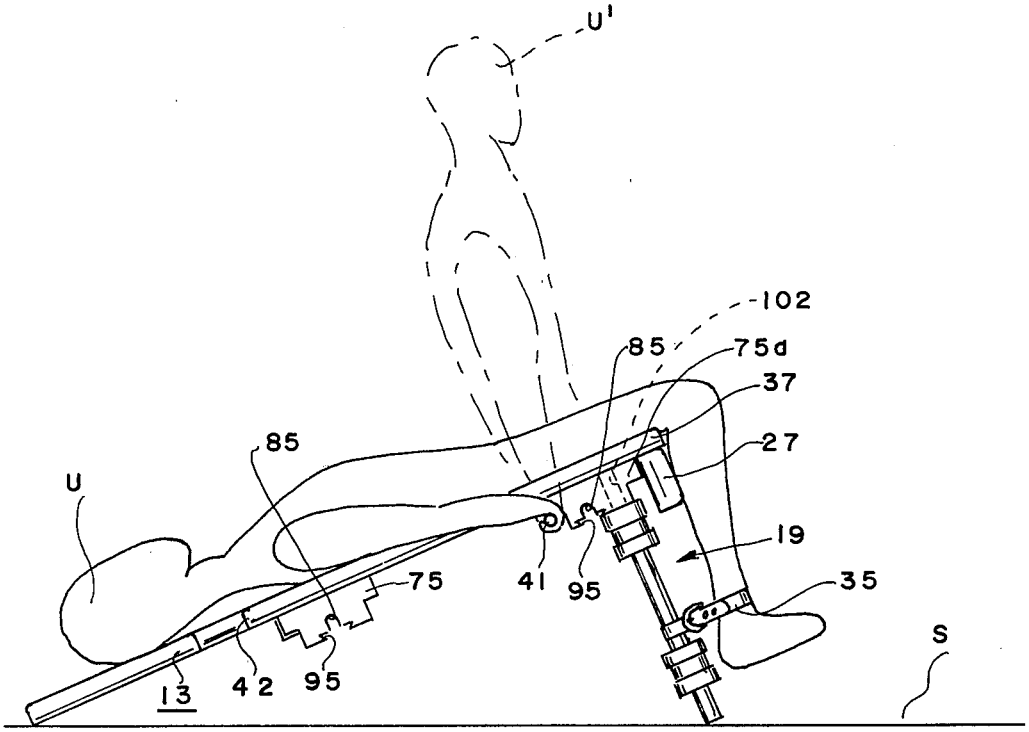
FIG. 8 depicts the exercising device arranged in a particular configuration so as to constitute what is commonly known as an abdominal board depicting a user in two positions which are shown to illustrate the manner for performing sit ups therewith.
Figure 9:
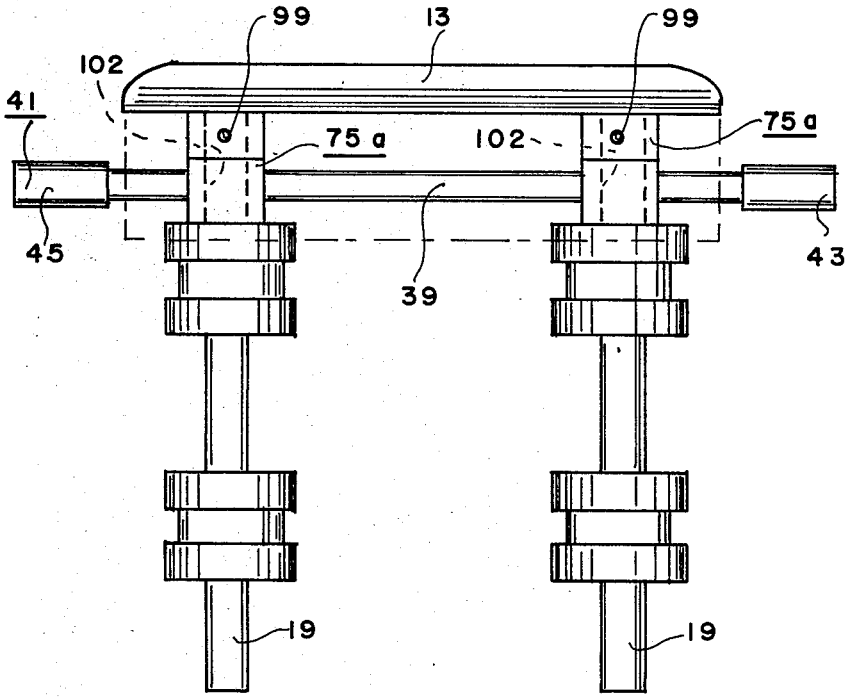
FIG. 9 is an end view taken of the device as shown in FIG. 8 with the view being taken from the right side thereof and certain structure being deleted therefrom.

Therefore, from FIGS. 1 and 3 of the drawings it may be seen that the exercising device 11 includes an oblong planar board member 13 for supporting the user U in any of several exercising positions, some of which are illustrated in FIGS. 8 and 20–23 of the drawings. The device 11 includes multi-utility means, as at 15 and best shown in FIG. 13 of the drawings, for selectively being arranged in any of a plurality of different usage modes which will be fully disclosed as this specification proceeds. From FIGS. 1 and 3–6 of the drawings it may clearly be seen that one of the usage modes of the multi-utility means 15 is the constitution thereby of roller means characterized by the numeral 17 for runningly ridably supporting the board member 13 in a horizontal disposition. On the other hand, from FIGS. 7–9 of the drawings, it may be seen that another of the usage modes of the multi-utility means 15 is the constitution thereby of leg means characterized by the numeral 19 for rigidly supporting the planar board member 13 in an inclined stationary disposition wherein the multi-utility means 15 or the leg means 19 supports an elevated end of the board member 13. Accordingly, the device 11 may selectively be utilized when in an inclined stationary condition as shown in FIGS. 7–9 and it may manually be urged by the user U to travel to-and-fro in a manner to be more fully disclosed as the specification proceeds.

Figures 4, 5, 24:
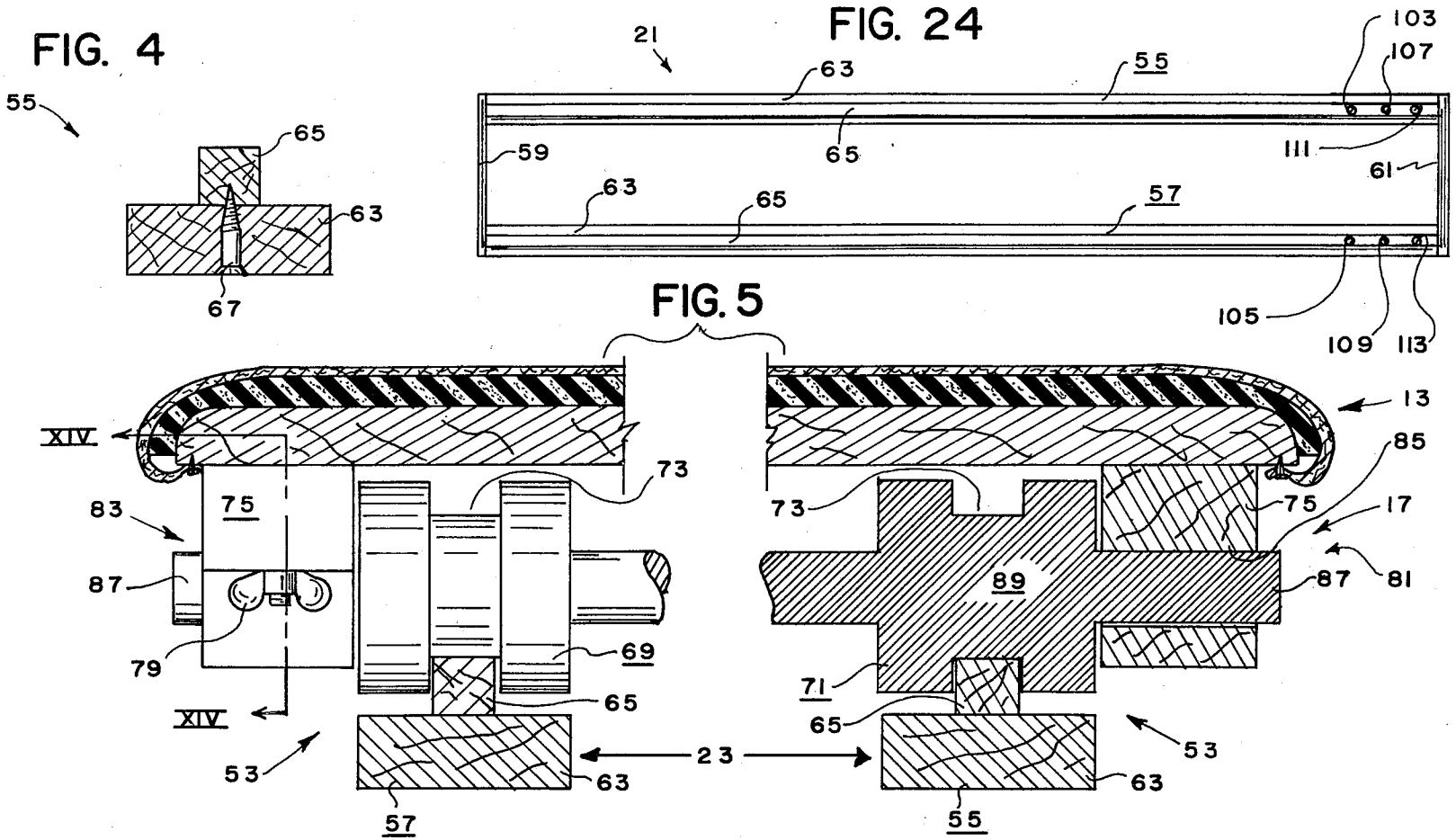
FIG. 4 is an enlarged sectional view taken as on the line IV—IV of FIG. 1 with the view having been rotated 90°.
FIG. 5 is an enlarged partial sectional view taken as on the line V—V of FIG. 1 with the view having been rotated 90°.
FIGS. 20–24 depict two configurations of the exercising device showing a user performing some of the preferred exercises therewith.

From FIG. 24 of the drawings it may be seen that the device 11 also includes rigid framelike means 21 for selectively being arranged in any of a plurality of different usage modes. From FIGS. 1, and 3–6 of the drawings it may be seen that one of the usage modes of the framelike means 21 is the constitution thereby of track means, as at 23. The track means 23 is for supportable engagement with the roller means 17 as the board member 13 is being runningly ridably supported by the roller means 17 in the travel to-and-fro of the board member 13. That is to say, the track means 23 supports the board member 13 while it is in the horizontal disposition thereof and in a manner as best shown in FIG. 3 of the drawings but to be fully disclosed as the specification proceeds.

Figure 16:
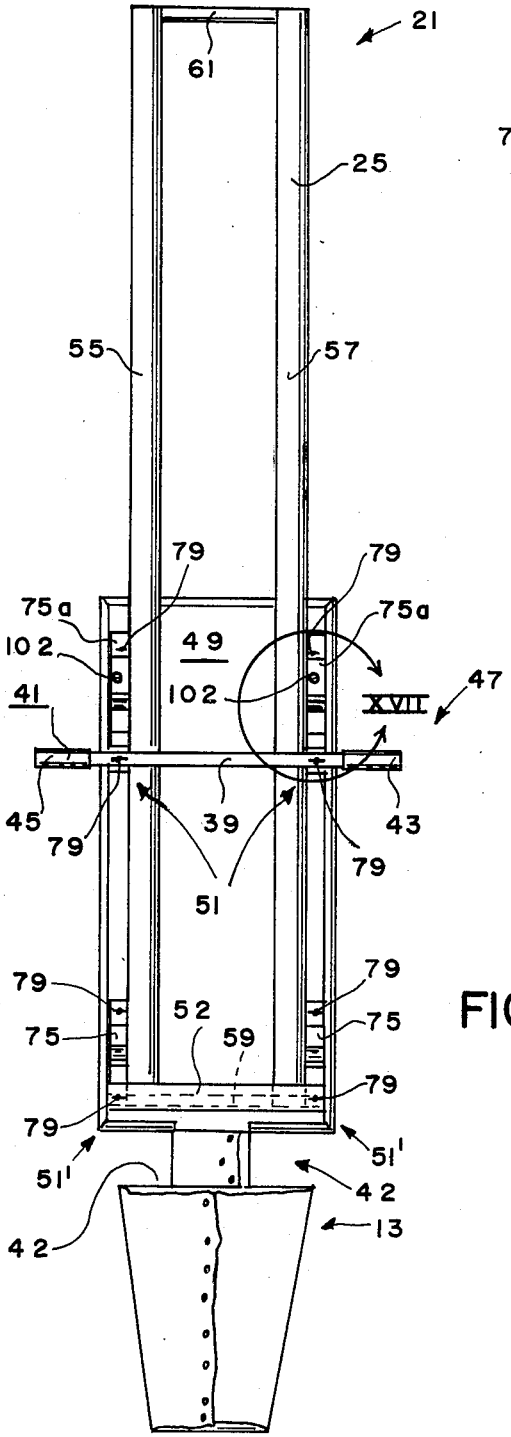
FIG. 16 is a bottom planar view of the oblong planar board member shown mated with the rigid framelike means or arranged somewhat like that depicted in FIG. 7 except certain structure has been deleted from FIG. 16.

From FIGS. 7 and 16 of the drawings, it may be seen that another of the usage modes of the framelike means 21 is the constitution thereby of reach means, as at 25, for extending the effective length of the board member 13 while in the inclined stationary disposition thereof. The rigid framelike means 21 is removably attached to the board member 13 in a particular manner so as to constitute the reach means 25. In this arrangement, the framelike means 21 is disposed so as to have a substantially co-planar relationship with the board member 13. Accordingly, the device 11 may be configured so as to establish what is known in the art as a slant board, i.e., as shown in FIG. 7. Since a slant board is well known, it would appear sufficient to simply state that the user accomplishes various exercises while normally assuming a supine position on the slant board or device 11 with his feet being placed at the elevated end thereof, i.e., the device 11 being restingly supported upon a horizontal supporting surface S.

From FIGS. 2 and 10–12 of the drawings it may be seen that the device 11 also includes an auxiliary member or, more specifically, readily detachable planar pad means 27. The auxiliary member 27 may optionally be simply referred to as detachable pad means for selectively being arranged in any of a plurality of different usage modes. From FIG. 7 of the drawings it may be seen that one of the usage modes of the auxiliary member 27 is the constitution of foot rest means, as at 29, for restingly supporting the feet of the user as he performs certain exercises with the device 11. Further, it may also clearly be seen that the detachable planar pad means 27 or the foot rest means 29 is disposed so as to have a substantially co-planar relationship with respect to the oblong planar board member 13. Moreover, it is detachably affixed (in a manner to be described) to the uppermost reaches, as at 31, of the reach means 25. Accordingly, in this manner, an elevated foot rest is provided that may be advantageously utilized by the user as he performs certain exercises with the device 11, i.e., when it is configured so as to constitute the slant board structure as shown in FIG. 7.

From FIG. 8 of the drawings it may be seen that another of the usages modes of the detachable planar pad means 27 is the constitution thereby of calve support means, as at 33, for restingly supporting the hinder part of the user's U legs as he performs certain exercises with the device 11.

More specifically, when the device 11 is configured as shown in FIG. 8, it becomes what is well known in the art as an abdominal board. In this configuration, the user U could, in addition to other exercises, perform sit ups and leg lifts. However, when performing sit ups the user moves from the position shown in solid lines by the letter U to the position shown in broken lines by the letter U'. Accordingly, the user U oftentimes will require some means for immoblizing his feet. Accordingly, the device 11 includes means, such as a belt 35, for manually binding the legs of the user to the leg means 19 of the device 11. This belt 35 facilitates the accomplishment of certain of the various exercises when the planar board member 13 is in the inclined stationary disposition thereof, or is configured so as to constitute the abdominal board as shown in FIG. 8 of the drawings.

From FIG. 8 of the drawings it may also be seen that the auxiliary member 27 is perpendicularly disposed with respect to the oblong planar board member 13. Additionally, the auxiliary member 27 is detachably affixed to the board member 13 (in a manner to be fully described) while depending from the upper most end thereof, as at 37. Moreover, this arrangement is effected as the board member 13 is disposed in the inclined stationary disposition thereof or so as to constitute an abdominal board.

Figure 22:
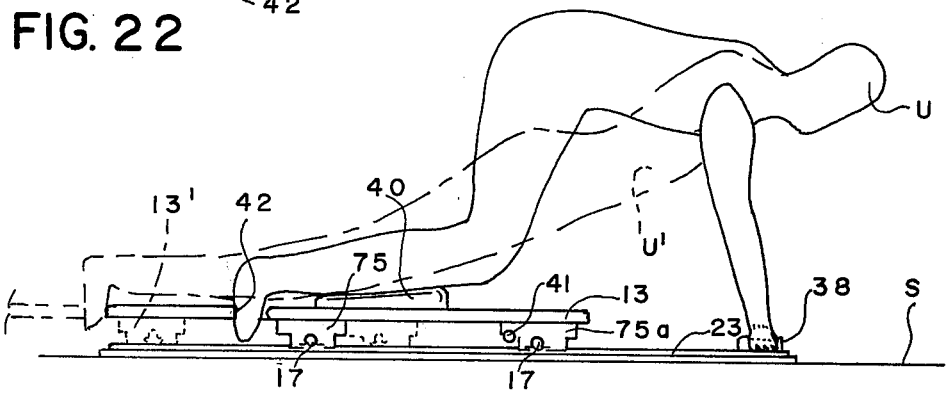

From FIG. 22 of the drawings it may be seen that another of the usage modes of the detachable planar pad means 27 is the constitution thereby of hand hold/hand pad means, as at 38, for restingly supporting the hands.

Moreover, applicant has found that when placing the hands on the floor when doing "roll-outs" it is not only awkward but it places a strain on the arms and shoulders. However, by locating the hand hand/hand pad means 28 on the track means 23 as shown in FIG. 22, this exercise is substantially facilitated. The specific manner in which the hand hold/hand pad means 28 is attached to the track means 23 will be apparent as the specification proceeds.

In addition, it may be seen in FIG. 22 of the drawings that the device 11 preferably includes a tapered cushion or knee protection means, as at 40, for relieving certain discomfort to the user U, i.e., particularly in the knee joints. In other words applicant has found that when kneeling totally on his knees, as opposed to supporting some weight on his shins by the use of the knee protection means 40, he has pulled the skin on his knee caps and developed some discomfort in his knee joints. Therefore, the knee protection means 40 is an important feature of the present invention since the use thereof overcomes the latter mentioned problem.

An important part of the present invention is the notches shown at 42 in FIGS. 1 and 22 of the drawings. These notches 42 are particularly advantageous in avoiding any tendency, on the part of the user U, to slide on the upholstered surface of the board member 13. Of course, if the user U were to slide on the board member 13 rather than urge the board member 13 to travel, one of the intended uses of the device 11 would be awkward or non-effective. Therefore, by providing the board member 13 with the notches 42, the user may simply insert his feet into the notches 42, thus his feet urge the board member 13 to travel in both directions without any tendency for the user U to slide on the upholstered surface of the board member 13.

From FIG. 9 of the drawings it may be seen that the device 11 includes transverse barlike means 39, which may alternately be referred to as primary transverse barlike means, for selectively being arranged in a plurality of different usage modes. Further, it may be seen that one of the usage modes of the primary transverse barlike means 39 is the constitution thereby of exercise assist means, as at 41 and as best shown in FIGS. 1 and 9 of the drawings. The exercise assist means 41 includes a pair of hand holds 43, 45 removably affixed to either out board side of the planar board member 13 and extending a distance outwardly therefrom. In this manner, the hand holds 43, 45 are adapted for selective gripping action by the hands of the user to facilitate the accomplishment of certain of the various exercises commensurate with the appropriate configuration of the device 11.

Figure 15:
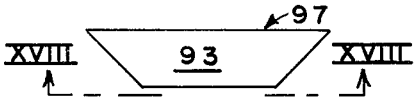
FIG. 15 is a side elevational view of a dovetail shaped accessory member of the present invention which is compatibly shaped with respect to the dovetail slot shown in FIG. 14.
Figure 17:
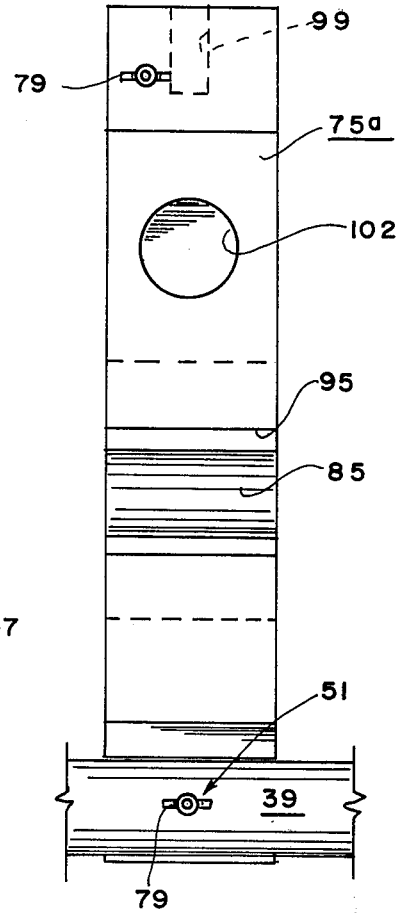
FIG. 17 is an enlarged view of the structure circumscribed by the arcuate line XVII in FIG. 16.
Figure 18:
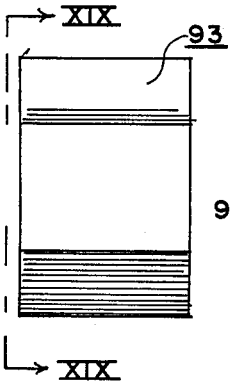
FIG. 18 is another view of the dovetail shaped acessory member with the view being taken as on the line XVIII—XVIII of FIG. 15 with the view having been rotated 90°.
Figure 19:
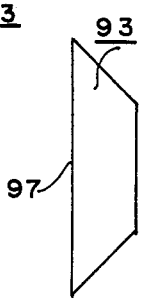
FIG. 19 is still another view of the dovetail shaped accessory member with the view being taken as on the line XIX—XIX of FIG. 18.

From FIG. 16 of the drawings it may be seen that the primary transverse barlike means 39 includes (at least in part) clamplike means, as at 47, for at least aiding in removably attaching the rigid framelike means 21 or the reach means 25 to the planar board member 13. More specifically, one end of the reach means 25 contiguously engages the underneath surface, as at 49, of the board member 13 while the primary transverse barlike means 39 aids in clampingly affixing the reach means 25 in this disposition. The clamplike means 47 also includes suitable bolt and nut structure, as at 51 and as best shown in FIG. 17 to facilitate rapid installation and removal of the barlike means 39. In addition, the clamplike means 47 preferably includes a secondary transverse bar or angle member 52 which is used merely to supplement the primary transverse barlike means 39 in clampingly affixing the framelike means 21 to the board member 13. Of course, additional bolt and nut structure, as at 51 in FIG. 15, may be used in like manner as the above mentioned similar structure 51.

Particular attention is now directed toward FIG. 5 of the drawings wherein it may be seen that the device 11 includes guide means, generally indicated at 53, for guidingly constraining the roller means 17 upon the track means 23. The guide means 53 is effective in assuring that the roller means 17 will be maintained in an optimum relationship with the track means 23 as the board member 13 is manually urged to travel to-and-fro along the track means 23.

More specifically, the guide means 53 entails providing compatible configuration of the roller means 17 with the track means 23 in a manner about to be disclosed.

The rigid framelike means 21 (FIG. 24) includes a pair of parallel spaced apart track members 55, 57 which are individually constructed in a manner best illustrated in FIG. 4 of the drawings. The remote ends of the track members 55, 57 are joined one to the other by a pair of metallic members 59, 61, e.g., formed from angle iron or extruded aluminum or the like. Each of the track members 55, 57 preferably is constructed from a lower plank 63 and a rail member 65. The rail member 65 is fixedly attached to the lower plank member 63 in any well known manner, e.g., as with screw structure 67 or the like.

Figure 13:
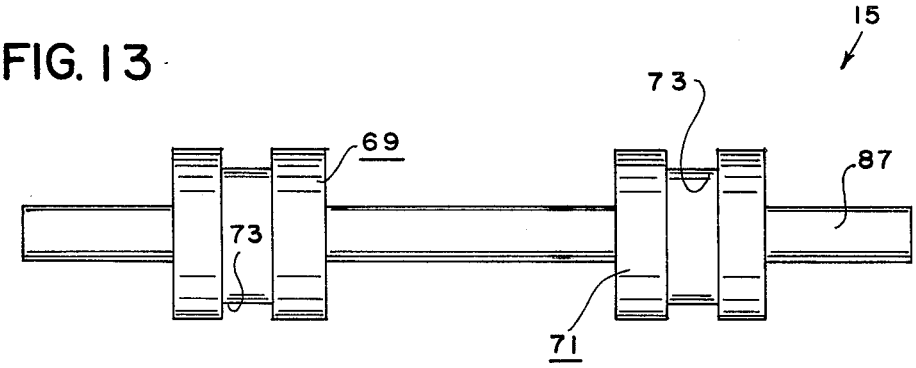
FIG. 13 is a front elevational view of the multi-utility means of the present invention which are also shown in FIGS. 5–9.

The structure of the roller means 17 constituting at least in part the above mentioned guide means 53 includes constructing the roller means 17 so as to have a pair of track engaging wheellike members 69, 71. Indeed, it should be mentioned that in each configuration or usage mode, the multi-utility means 15 (the roller means 17 or the leg means 19) embraces a pair of identical members as clearly shown in FIG. 9, i.e., merely one of which is shown in FIG. 5 or 13. Thus each of the identical pair of roller means 17 includes a pair of the above mentioned wheellike members 69, 71. In addition, each of the roller means 17 is constructed so that the wheellike members 69, 71 have a spaced apart distance which is compatible with the track members 55, 57. Moreover, each of the wheellike members 69, 71 is provided with an annular groove, as at 73 and which is compatibly shaped with the rail member 65.

Figure 6:
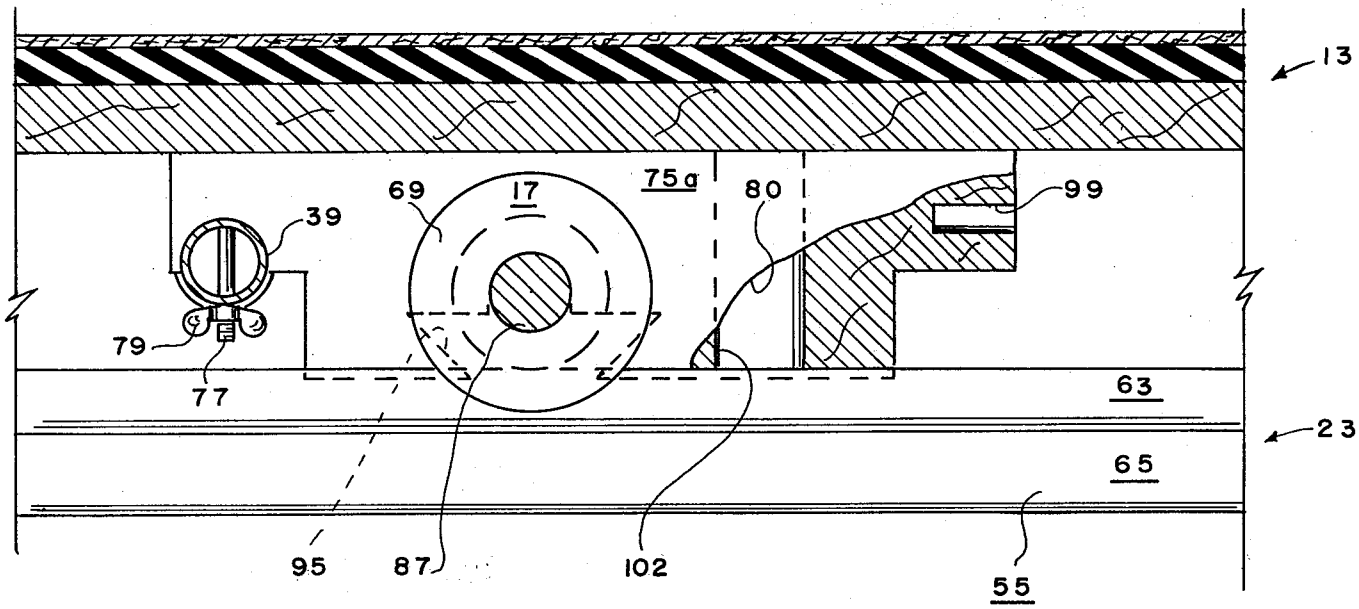
FIG. 6 is an enlarged partial sectional view taken as on the line VI—VI of FIG. 1.

From FIG. 16 of the drawings it may be seen that the device 11 includes a plurality of block members 75 each of which includes structure best shown in FIGS. 5, 6 and 17 of the drawings. Each of the block members 75 (preferably being four in number) is attached to the board member 13 by a pair of bolts 77 (see FIG. 14) extending through suitable apertures and respectively held in place by a pair of wing nuts 79 or the like. However, the cutaway, as at 80 in FIG. 6 of the drawings, removes from view the second bolt 77 and wing nut 79, i.e., so as to better depict other structure yet to be disclosed. It should be understood that the previously mentioned bolt and nut structure 51 and 51' (FIGS. 16, 17) preferably is included with the just mentioned wing nut 79. However, since they may serve two different distinct functions, they are not necessarily indentical.

Figure 14:
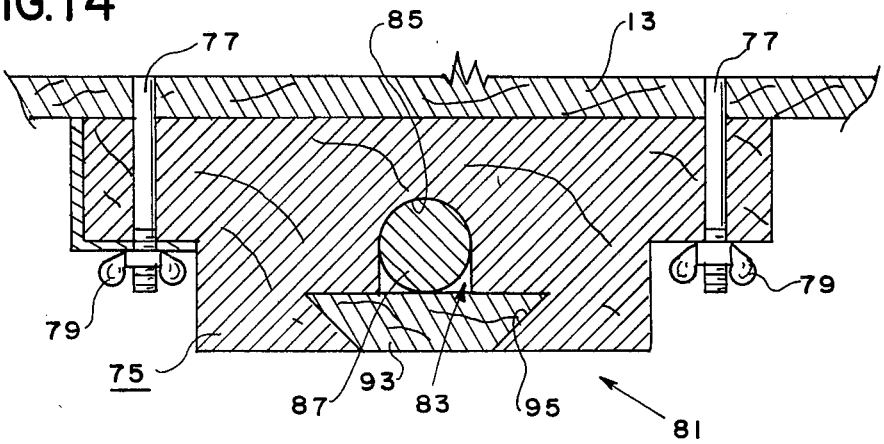
FIG. 14 is a sectional view taken as on the line XIV—XIV of FIG. 5.

Particular attention is now directed towards FIGS. 5 and 14 of the drawings wherein it may be seen that the device 11 includes means, generally indicated at 81, for promoting resistance against enabling the planar board member 13 to merely be free to travel to-and-fro as it is being runningly ridably supported by the multi-utility means 15 or the roller means 17. The means 81 for promoting resistance is effectively utilized by requiring the user to exert more effort in the performance of certain exercises than would normally be expected if the to-and-fro travel of the board member 13 were to be conventionally unconstrained.

More specifically, the means 81 for promoting resistance includes close fitting means shown at 83 for abnormally developing friction between the roller means 17 and the planar board member 13 or more specifically the block members 75 attached thereto.

Moreover, the close fitting means 83 includes providing each of the block members 75 with an arcuate shaped groove, as at 85 in FIG. 14, which is compatiably shaped with the diameter of an axle member 87 of the roller means 17. Therefore, as the user manually urges the board member 13 to travel to-and-fro, the close fitting relationship of the axle member 87 within the arcuate shaped groove 85 develops friction which must be overcomed by the user in performing certain of the exercises. Of course, the friction being so developed is proportional to the weight of the user. Therefore, a heavy adult user would be required to exert more effort in causing the board member 13 to travel to-and-fro then would a light weight child, etc.

It will be appreciated by those skilled in the art that the roller means per se as above described could be constructed by any of several well known concepts. However, applicant believes that an important part of the present invention involves a departure from conventional concepts with respect to the construction of the roller means 17.

Moreover, the previously mentioned means 81 for promoting resistance also is intended to include inertia means generally indicated at 89 for providing a degree of constraint to the to-and-fro travel of the planar board member 13. In this manner, the inherent massiveness of the multi-utility means 15 contributes to the means 81 for promoting resistance. Indeed, the roller means 17 preferably is formed from relatively heavy, solid, cold-rolled steel stock or the like so as to have an optimum degree of inherent massiveness and inertia thereto.

Figure 20:
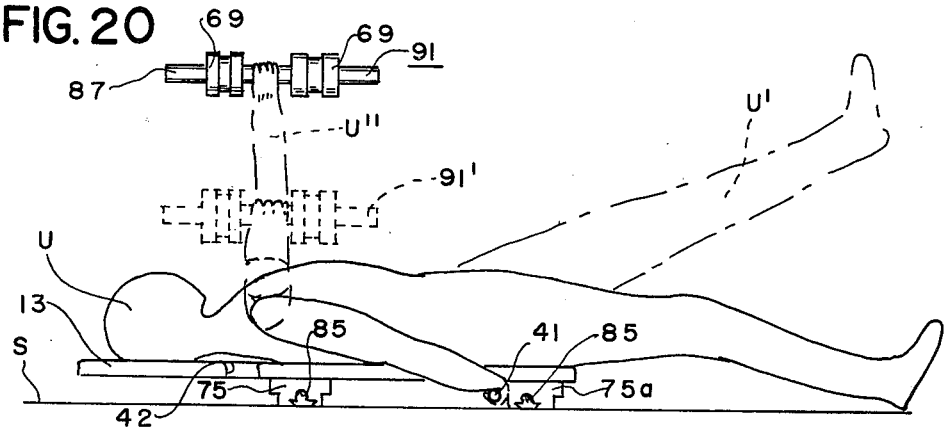

In view of the above stipulated construction concept for the multi-utility means 15 or the roller means 17, it will be appreciated that still another of the usage modes of the multi-utility means 15 is the constitution thereby of dumb bell means, as at 91 in FIG. 20 of the drawings which are for use in exercising certain muscles. The wheellike members 69, 71 and the axle member 87 insures that the pair of dumb bell means 91 are adapted to be comfortably grasped in either hand of the user U while moving his arms in a particular manner, i.e., the user U in FIG. 20 is depicted as raising and lowering the dumb bell means 91 from a position shown in solid lines by the numeral 91 to a position shown in broken lines indicated by the numeral 91'.

Therefore, the inherent massiveness of the dumb bell means 91 is effectively utilized by requiring the user U" to exert a degree of effort in accomplishing otherwise normal movements of certain parts of his body. Of course, it should be understood that the dumb bell means 91 as shown in FIG. 20 is not limited to merely this movement for exercise since many other well known exercises may be performed therewith.

Applicant recognizes that there may be certain circumstances that would make it desirable for the roller means 17 to be secured to the block members 75, i.e., in an operable position thereof, in such a manner that the axle member 87 may be rotatably mated with the arcuate shaped grooves 85. Therefore, from FIGS. 14, 15, 18 and 19 of the drawings it may be readily seen that the exercising device 11 includes a plurality of dovetail shaped accessory members 93, i.e., one such accessory member 93 being provided for each of the four block members 75.

The accessory members 93 may simply be slidably received within a compatiably shaped dovetail groove 95 provided in each of the block members 75 as best shown in FIG. 14 of the drawings.

While the primary purpose of the accessory members 93 is to secure the roller means 17 to the block members 17, it will be appreciated that the accessory members 93 may also contribute, to a degree, to the previously mentioned means 81 for promoting resistance. More specifically, the upper surface, as at 97, of the accessory members 93 may be adapted to frictionally engage the axle member 87. Thus, the friction so developed requires the user U to exert even more effort in the performance of certain exercises.

From FIGS. 6, 9 and 17 of the drawings it may be seen that the distal block members 75 which hereinafter will further be characterized by the letter "a" suffix, thus 75*a*, are provided with a relatively small socket, as at 99, and for purposes yet to be disclosed.

Figure 10:
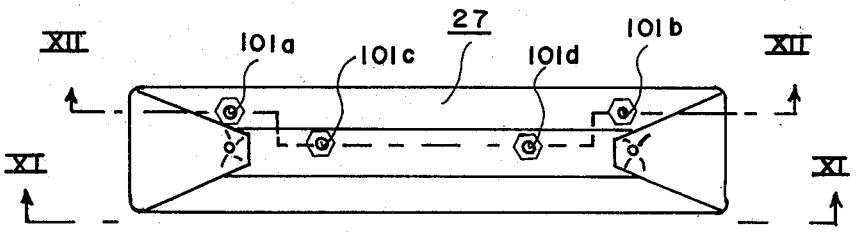
FIG. 10 is a bottom plan view of the auxiliary member shown in FIG. 2 of the drawings.
Figure 11:
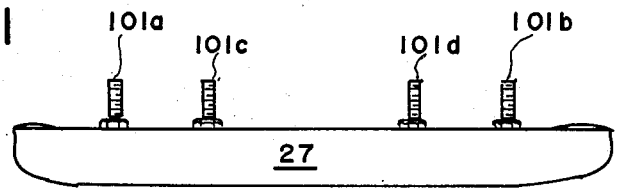
FIG. 11 is a view taken along the line XI—XI of FIG. 10.
Figure 12:
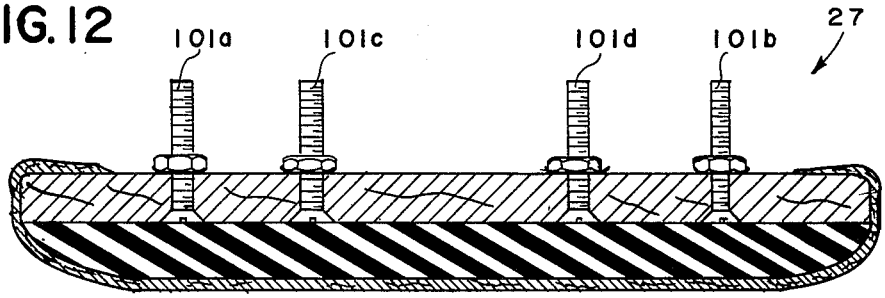
FIG. 12 is an enlarged sectional view taken as on the line XII—XII of FIG. 10.

From FIGS. 10–12 of the drawings it may readily be seen that the auxiliary member or pad means 27 includes a plurality of stud members 101 which may individually be designated as 101*a*, 101*b*, 101*c* and 101*d*. Moreover, the studs 101*a*, 101*b* are arranged so as to readily be received in the above mentioned sockets 99 which, of course, are compatibly shaped with the stud members 101. Accordingly, when the device 11 is used as shown in FIG. 8 of the drawing, the pad means 27 may be attached to the board member 13 so as to establish the calves support means 33 by simply inserting the stud members 101*a*, 101*b* into the sockets 99.

In addition, from FIGS. 7–9, 16 and 17 of the drawings, it may be seen that each of the block members 75*a* is provided with a relatively large socket, as at 102, for receiving the leg means 19. More specifically, one end of the axle member 87 may simply be inserted into the socket 102, thus the leg means 19 is established by the multi-utility means 15.

On the other hand, when the exercising device 11 is to be used in the manner or configuration as shown in FIG. 7 of the drawings, the auxiliary member or pad means 27 is relied upon to constitute the foot rest means 29 in a manner about to be described. From FIGS. 1 and 24 of the drawings, it may be seen that the track members 55, 57 are provided with several pairs of apertures, as at 103, 105; 107, 109; and 111, 113. The spaced apart distance between the stud members 101*c*, 101*d* is determined by the spaced apart distance between each of the several pairs of apertures, e.g., the spacing between apertures 103, 105 is compatible with the spacing between the stud members 101*c* and 101*d*.

Therefore, it may readily be seen that inserting the stud members 101*c*, 101*d* within any one pair of the several pairs of apertures, e.g., the apertures 103, 105, is effective in constituting the foot rest means 29 as shown in FIG. 7 of the drawings. Moreover, it may be seen that the foot rest means 29 may be adjustably placed at different locations along the reach means 25 so as to be comfortably adjustable to different size users, i.e., by selecting the appropriate pair of apertures, e.g., the apertures 111, 113 would be for a taller user than would the apertures 103, 105, etc.

The following is intended to generally disclose the operation of the exercise device 11. However, it should be understood that it is anticipated that the exercising device 11 would be used for accomplishing certain other exercises in conjunction therewith in a manner well known to those skilled in the art. As mentioned previously, no attempt will be made to describe any of the exercises that may be accomplished by using the device 11 as a slant board or as shown in FIG. 7 of the drawings. Indeed, the only exercise that will be described for the abdominal board configuration as shown in FIG. 8 will be the one type of sit up exercise which was previously mentioned in order to illustrate the function of the belt 35.

FIG. 20 of the drawings illustrates how the device 11 is intended to be used in conjunction with leg lift exercises. It will be noted that the user U' may optionally utilize the exercise assist means 41 while performing the leg lift exercise. Specifically, the user U assumes a supine position with his torso and head comfortably resting upon the board member 13 while he simply lifts either or both legs alternately or simultaneously to the position characterized by the letter U'. In addition, the user U may optionally make use of the dumb bell means 91 in the manner previously described and/or in other well known exercise procedures.

Figure 21:
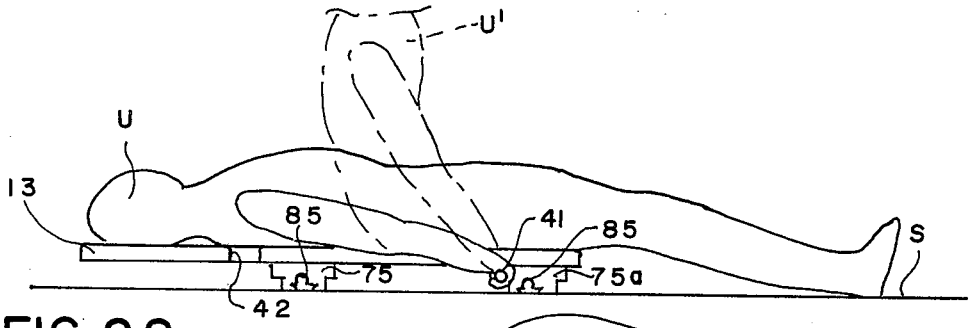

FIG. 21 of the drawings illustrates how the device 11 may be used in conjunction with accomplishing another type sit up exercise. This exercise is performed in conjunction with the device 11 by the user U assuming the same position as above mentioned for the leg lift exercise. In this sit up exercise the assist means 41 or more specifically the hand grip members 43, 45 have significant importance since many individuals, for one reasons or another, are physically unable to accomplish sit ups with out assistance in one form or another. The exercising device 11 of the present invention solves this problem for these individuals by enabling the user U to grasp the hand grip members 43, 45 thus using his arms in a pulling manner to assist him in sitting up to the position U'. It should be noted that the device 11 remains stationary while performing the just described body movements in conjunction therewith, i.e., the leg lift exercise and the sit up exercise, thus none the less, effectively exercising the abdominal muscles in so doing.

From FIG. 22 of the drawings it may be seen that the device 11 may be used in conjunction with a roll-out exercise. In this exercise, the user U assumes a kneeling position with lower legs comfortably resting on the knee protection means 40 as clearly shown. The pad means 27 or the hand hold/hand pad means 38 is attached to the track means 23 by inserting the appropriate studs 101*c*, 101*d* into the apertures 103, 105 respectively (see FIGS. 1, 12). As the user U grasps the outer ends of the hand pad means 38 he simply pushes or straightens his legs to a position substantially in line with his torso thus moving to the position U'. It will be noted that the device 11 is thusly manually urged to-and-fro into the position 13', or along the major axis thereof. This action is facilitated by the user U placing his feet within the notches 42, as mentioned previously. As the user U repeats this exercise cycle he also effectively exercises the abdominal muscles in so doing.

Figure 23:
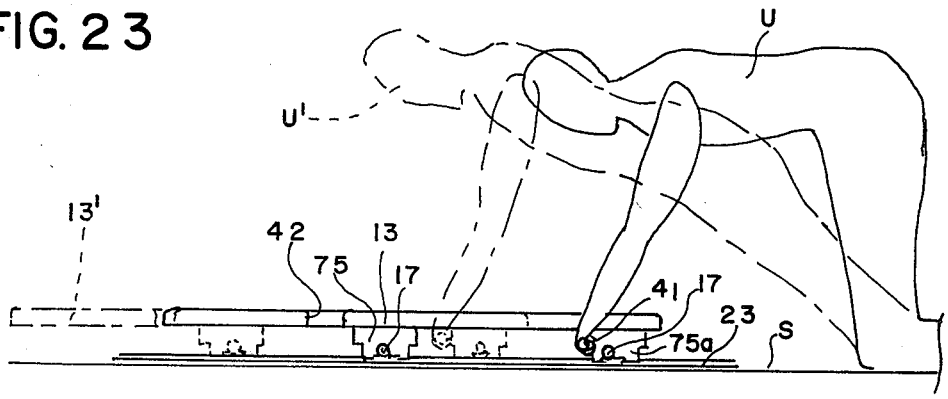

From FIG. 23 of the drawings it may be seen that the device 11 may be used in conjunction with accomplishing a reverse roll-out exercise. The reverse roll-out exercise is preferably accomplished by the user U assuming a kneeling position, with his knees comfortably resting upon the support surface or floor S as clearly shown. While grasping the exercise assist means 41, or more specifically the hand grip members 43, 45, he pushes forward or somewhat straightens his legs so as to assume a position as at U'. It will be noted that in moving to the position U' the device 11 is manually urged to move or runningly ride to-and-fro upon the track means 23, i.e., to the position 13', or along the major axis thereof by the user U as he cyclically repeats the reverse roll-outs exercise.

Therefore, the device 11 may manually be urged to move against the resistance means 81. In other words, the device is urged to travel to-and-fro along the major axis thereof by the user U while assuming the above described positions as illustrated in FIGS. 22, 23. Moreover, he accomplishes this travel by performing the push out body movements or somewhat leg straightening positions as above described but in conjunction with the device 11. Therefore, he is effectively exercising his abdominal muscles in so doing.

It is significant to note that the device 11 may easily and quickly be stored under a bed or in a closet or the like when not being used. Therefore, it may be conveniently available for exercising on a strict disciplined program while not occupying valuable limited space when not in use.

Although the invention has been described and illustrated with respect to a preferred embodiment thereof, it should be understood that the device is not intended to be so limited since changes and modifications may be made therein without departing from the spirit and scope of the present invention.

I claim:

1. An exercising device for exercising particular muscles of a user as he selectively accomplishes various exercises in conjunction therewith, said exercising device comprising an oblong planar board member for supporting the user in any of several exercising positions, fore and aft roller means for runningly ridably supporting said board member in a horizontal disposition, track means for supportable engagement with said roller means as said board member is being runningly ridably supported by said roller means in a to-and-fro travel of said board member, and means for promoting resistance against enabling said planar board member to merely be free to travel to-and-fro as it is being runningly ridably supported by said roller means upon said track means, said means for promoting resistance effectively being utilized by requiring the user to exert more effort in the performance of certain exercise than would normally be expected if the to-and-fro travel of said board member were to be conventionally unconstrained, said means for promoting resistance including close fitting means for abnormally developing friction between said roller means and said planar board member, said close fitting means including providing said board member with a plurality of block members for respectively engaging said fore and aft roller means, each of said roller means including an axle member having a pair of track engageable wheellike members disposed adjacent opposite ends thereof and being integrally joined therewith thus precluding relative rotation between said wheellike members and said axle member, each of said block members being provided with an arcuate shaped downwardly directed groove compatibly sized with said axle member for reception therein but in a particular fashion in which a close fitting relationship of said axle member within said arcuate shaped groove is established for purposely causing the development of friction therebetween as rotation of said axle member is established by the to-and-fro travel of said board member.

* * * * *